US011332226B2

(12) United States Patent
Nakamura

(10) Patent No.: US 11,332,226 B2
(45) Date of Patent: May 17, 2022

(54) VESSEL

(71) Applicant: YAMAHA HATSUDOKI KABUSHIKI KAISHA, Iwata (JP)

(72) Inventor: Mitsuyoshi Nakamura, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 95 days.

(21) Appl. No.: 17/026,351

(22) Filed: Sep. 21, 2020

(65) Prior Publication Data

US 2021/0107613 A1 Apr. 15, 2021

(30) Foreign Application Priority Data

Oct. 11, 2019 (JP) ..... JP2019-187575

(51) Int. Cl.

| | |
|---|---|
| ***B63H 11/04*** | (2006.01) |
| ***B63B 3/14*** | (2006.01) |
| ***B63B 34/10*** | (2020.01) |
| ***B63H 23/32*** | (2006.01) |
| ***B63H 23/34*** | (2006.01) |
| ***B63B 11/06*** | (2006.01) |

(52) U.S. Cl.

CPC ..... *B63H 11/04* (2013.01); *B63B 3/14* (2013.01); *B63B 11/06* (2013.01); *B63B 34/10* (2020.02); *B63H 23/321* (2013.01); *B63H 23/34* (2013.01)

(58) Field of Classification Search

CPC ..... B63H 11/00; B63H 11/02; B63H 11/04; B63H 23/32; B63H 23/321; B63H 23/322; B63H 23/325; B63H 23/34

USPC ..... 440/440, 38, 52, 83

See application file for complete search history.

(56) References Cited

U.S. PATENT DOCUMENTS

| | | | | |
|---|---|---|---|---|
| 3,601,989 | A * | 8/1971 | Austin | B63H 11/08 60/221 |
| 5,372,526 | A | 12/1994 | Ozawa et al. | |
| 5,618,213 | A | 4/1997 | Nanami | |
| 6,415,728 | B1 | 7/2002 | Maeda et al. | |
| 6,645,018 | B2 * | 11/2003 | Ishigaki | B63H 11/08 440/46 |
| 6,695,656 | B2 * | 2/2004 | Fuse | B63H 23/321 440/38 |
| 2005/0124236 | A1 | 6/2005 | Nakamura et al. | |

FOREIGN PATENT DOCUMENTS

| | | | |
|---|---|---|---|
| JP | 06-48386 | A | 2/1994 |
| JP | 07-205888 | A | 8/1995 |
| JP | 08-40374 | A | 2/1996 |

(Continued)

*Primary Examiner* — Daniel V Venne

(74) *Attorney, Agent, or Firm* — Keating and Bennett, LLP

(57) ABSTRACT

A vessel includes a vessel body, an engine, a propulsion device, a drive shaft, a partition wall, a bearing, an elastic member, an outer housing, and a positioning member. The drive shaft transmits a driving force of the engine to the propulsion device, and the propulsion device generates a thrust by the driving force. The drive shaft is inserted into an insertion hole of the partition wall. The bearing rotatably supports the drive shaft. The elastic member supports the bearing. The outer housing supports the elastic member, and is fixed to the partition wall. The positioning member positions the elastic member with respect to the bearing and the outer housing by pressing the elastic member.

18 Claims, 5 Drawing Sheets

(56) References Cited

FOREIGN PATENT DOCUMENTS

| | | | |
|---|---|---|---|
| JP | 08-67296 | A | 3/1996 |
| JP | 2588245 | Y2 | 1/1999 |
| JP | 3111187 | B1 | 11/2000 |
| JP | 4387158 | B2 | 12/2009 |

* cited by examiner

VESSEL

CROSS REFERENCE TO RELATED APPLICATIONS

This application claims the benefit of priority to Japanese Patent Application No. 2019-187575 filed on Oct. 11, 2019. The entire contents of this application are hereby incorporated herein by reference.

BACKGROUND OF THE INVENTION

1. Field of the Invention

The present invention relates to a vessel.

2. Description of the Related Art

Japanese Patent Application Publication No. 8-67296 discloses a water-jet propulsion watercraft. This water-jet propulsion watercraft includes a vessel body, an engine mounted inside the vessel body, and a water-jet propulsion device disposed behind the engine. The output of the engine is transmitted to the water-jet propulsion device through a connecting shaft (drive shaft) causing the water-jet propulsion watercraft to travel. The connecting shaft is supported by a bearing disposed inside the vessel body. In more detail, the bearing is disposed at a mounting bracket fixed to a vessel bottom. The bearing includes a housing fixed to the mounting bracket, a collar housed in the housing, a ball bearing that is built into the collar and that supports the connecting shaft, and a rubber damper that is disposed between the housing and the collar and that absorbs a displacement of the connecting shaft.

It is a common practice for the rubber damper to be bonded to the housing and to the collar (for example, cure adhesion) although Japanese Patent Application Publication No. 8-67296 does not give a detailed description of this. However, the adhesion of the rubber damper is a time-consuming job, and therefore production costs are increased. Additionally, in the water-jet propulsion watercraft of Japanese Patent Application Publication No. 8-67296, the mounting bracket, which is a dedicated component, is provided to fix the bearing, and therefore production costs become even higher.

SUMMARY OF THE INVENTION

In order to overcome the previously unrecognized and unsolved challenges described above, preferred embodiments of the present invention provide vessels that each include a vessel body, an engine, a propulsion device, a drive shaft, a partition wall, a bearing, an elastic member, an outer housing, and a positioning member. The propulsion device generates a thrust with a driving force of the engine. The drive shaft transmits the driving force of the engine to the propulsion device. An insertion hole into which the drive shaft is inserted is provided in the partition wall. The bearing rotatably supports the drive shaft. The elastic member supports the bearing. The outer housing supports the elastic member, and is fixed to the partition wall. The positioning member positions the elastic member with respect to the bearing and the outer housing by pressing the elastic member.

According to the above structural arrangement, the drive shaft is rotated by the driving force of the engine, and the driving force of the engine is transmitted to the propulsion device due to the rotation of the drive shaft. The propulsion device generates a thrust by the transmission of the driving force of the engine. The drive shaft is rotatably supported by the bearing in a state in which the drive shaft is inserted in the insertion hole in the partition wall. The bearing is elastically supported by the elastic member, and therefore vibrations of the drive shaft and of the bearing that result from the rotation of the drive shaft and the like are absorbed by the elastic deformation of the elastic member. Therefore, it is possible to significantly reduce or prevent vibrations of the drive shaft and of the bearing from being transmitted to the vessel body. Additionally, the displacement of the drive shaft and the displacement of the bearing are permitted when vibrations occur, and, as a result, fatigue caused by vibrations is not easily accumulated on these components, and therefore it is possible to significantly reduce or prevent these components from being broken.

The elastic member is supported by the outer housing fixed to the partition wall. The elastic member is pressed by the positioning member, and thus is positioned with respect to the bearing and the outer housing. Therefore, the elastic member is not required to be bonded to the bearing and to the outer housing in order to position the elastic member. Therefore, it is possible to reduce production costs for an arrangement that supports the drive shaft.

In a preferred embodiment of the present invention, the positioning member positions the elastic member with respect to the bearing and the outer housing by pressing the elastic member toward the partition wall.

According to the above structural arrangement, the elastic member is pressed toward the partition wall by the positioning member, and thus is compressed in a pressing direction by the positioning member. Accordingly, the elastic member spreads in a direction that intersects the pressing direction. Therefore, if the bearing and the outer housing extend in the direction in which the elastic member spreads, the elastic member after spreading is positioned with respect to the bearing and the outer housing by being tightly pressed into contact with the bearing and the outer housing. Thus, the elastic member is not required to be bonded to the bearing and to the outer housing in order to position the elastic member. Therefore, it is possible to reduce production costs for an arrangement that supports the drive shaft.

In a preferred embodiment of the present invention, the partition wall is fixed to the vessel body.

According to the above structural arrangement, the partition wall is fixed to the vessel body, and the outer housing supports the elastic member in a state in which the outer housing is fixed to the partition wall. Thus, the elastic member is fixed to the vessel body through the outer housing and the partition wall, thus making it possible to support the bearing in a state in which positional stability is maintained. This enables the bearing to support the drive shaft in a state in which positional stability is maintained.

In a preferred embodiment of the present invention, the vessel further includes an inner housing that houses the bearing. The elastic member supports the bearing through the inner housing.

According to the above structural arrangement, the elastic member supports the bearing through the inner housing that houses the bearing. In this case, when the positioning member positions the elastic member with respect to the inner housing by pressing the elastic member, the elastic member is also positioned with respect to the bearing disposed in the inner housing. Thus, the elastic member is not required to be bonded to the inner housing and to the outer housing in order to position the elastic member.

Therefore, it is possible to reduce production costs for an arrangement that supports the drive shaft.

In a preferred embodiment of the present invention, the elastic member is not bonded to the inner housing or to the outer housing.

According to the above structural arrangement, even if the elastic member is not bonded to the inner housing and is not bonded to the outer housing, the elastic member is positioned with respect to the inner housing and the outer housing by being pressed by the positioning member. Thus, the elastic member is not required to be bonded to the inner housing, to the bearing disposed in the inner housing, and to the outer housing in order to position the elastic member. Therefore, it is possible to reduce production costs for an arrangement that supports the drive shaft.

In a preferred embodiment of the present invention, the outer housing is integral and unitary with the partition wall.

According to the above structural arrangement, the outer housing that supports the bearing through the elastic member is integral and unitary with the partition wall, and therefore it is possible to reduce the number of components. Therefore, it is possible to reduce production costs for an arrangement that supports the drive shaft.

In a preferred embodiment of the present invention, the outer housing includes a cylindrical body that surrounds the drive shaft.

According to the above structural arrangement, the outer housing that supports the bearing through the elastic member includes a cylindrical body that is simple in shape, and therefore it is possible to easily produce the outer housing. Therefore, it is possible to reduce production costs for an arrangement that supports the drive shaft.

In a preferred embodiment of the present invention, the outer housing includes a cylindrical body surrounding the drive shaft and including a peripheral wall that extends in a circumferential direction of the drive shaft and an end wall that is connected to an end portion of the peripheral wall and that intersects the drive shaft. The outer housing faces the partition wall. The vessel further includes a connection member that connects the peripheral wall to the partition wall.

According to the above structural arrangement, although the outer housing that supports the bearing through the elastic member is a component different from the partition wall, the outer housing includes a cylindrical body that is simple in shape, and therefore it is possible to easily produce the outer housing. Therefore, it is possible to reduce production costs for an arrangement that supports the drive shaft.

In a preferred embodiment of the present invention, the positioning member includes the end wall.

According to the above structural arrangement, the end wall of the outer housing that supports the bearing through the elastic member also defines and functions as a positioning member that positions the elastic member, and therefore it is possible to reduce the number of components. Therefore, it is possible to reduce production costs for an arrangement that supports the drive shaft.

In a preferred embodiment of the present invention, the outer housing includes a plurality of components that are separable from each other.

According to the above structural arrangement, if it is difficult to produce the outer housing that supports the bearing through the elastic member as an integral and unitary structure, the outer housing is made of a plurality of components that are separable from each other. An operator is able to complete the outer housing by combining these components together. This makes it possible to use the outer housing having a desired structure, and makes it possible to reduce production costs for an arrangement that supports the drive shaft.

In a preferred embodiment of the present invention, the inner housing includes a cylindrical body that surrounds the drive shaft.

According to the above structural arrangement, the inner housing that houses the bearing includes a cylindrical body that is simple in shape, and therefore it is possible to easily produce the inner housing. Therefore, it is possible to reduce production costs for an arrangement that supports the drive shaft.

In a preferred embodiment of the present invention, the vessel further includes a first seal disposed side by side with the bearing in the inner housing and that closes a gap between the inner housing and the drive shaft.

According to the above structural arrangement, a gap between the inner housing and the drive shaft supported by the bearing in the inner housing is closed by the first seal, and therefore it is possible to significantly reduce or prevent foreign substances, such as water, from entering the gap.

In a preferred embodiment of the present invention, the vessel further includes a second seal that closes a gap between the inner housing and the drive shaft. The second seal is disposed such that the bearing is sandwiched between the first seal and the second seal in the inner housing.

According to the above structural arrangement, the gap between the inner housing and the drive shaft supported by the bearing in the inner housing is closed not only by the first seal but also by the second seal so that the bearing is sandwiched between the first seal and the second seal. This makes it possible to more significantly reduce or prevent foreign substances, such as water, from entering the gap, and additionally makes it possible to significantly reduce or prevent foreign substances from adhering to the bearing.

In a preferred embodiment of the present invention, the inner housing includes a first portion and a second portion. The first portion surrounds the bearing, the first seal, and the second seal. The second portion is smaller in diameter than the first portion, and is inserted into the insertion hole while extending from the first portion to the partition wall in a state in which the second portion surrounds the drive shaft.

According to the above structural arrangement, a portion of the drive shaft supported by the bearing that is inserted in the insertion hole of the partition wall is surrounded by the second portion of the inner housing that houses the bearing, and therefore the portion of the drive shaft is isolated from the peripheral edge portion of the insertion hole of the partition wall. Thus, even if the bearing supported by the elastic member is displaced by vibrations or the like, the drive shaft displaced together with the bearing is protected by the second portion so as not to come into contact with the peripheral edge portion of the insertion hole of the partition wall. Therefore, it is possible to significantly reduce or prevent the drive shaft from being broken due to contact of the drive shaft with the peripheral edge portion of the insertion hole.

In a preferred embodiment of the present invention, the elastic member includes a cylindrical body that surrounds the drive shaft.

According to the above structural arrangement, the elastic member that supports the bearing includes a cylindrical body that is simple in shape, and therefore it is possible to easily produce the elastic member. Therefore, it is possible to reduce production costs for an arrangement that supports the drive shaft.

In a preferred embodiment of the present invention, the elastic member includes a portion that is sandwiched between the first portion and a peripheral edge portion of the insertion hole in the partition wall.

According to the above structural arrangement, a gap between the first portion of the inner housing and the peripheral edge portion of the insertion hole of the partition wall is closed by a portion of the elastic member, and therefore it is possible to significantly reduce or prevent foreign substances, such as water, from entering the gap.

In a preferred embodiment of the present invention, a hole is provided in the elastic member to lighten the weight of the elastic member.

According to the above structural arrangement, it is possible to reduce the amount of material of the elastic member that supports the bearing, and therefore it is possible to reduce production costs for an arrangement that supports the drive shaft. Additionally, it is possible to adjust the spring constant of the elastic member that is deformed by being pressed by the positioning member in accordance with the size or the shape of the hole. Thus, it is possible to adjust the degree of adhesion of the elastic member to the bearing and to the outer housing by adjusting the spring constant of the elastic member. Therefore, it is possible to position the elastic member with respect to the bearing and with respect to the outer housing by the necessary strength even if the elastic member is not bonded to the bearing and to the outer housing. Therefore, it is possible to reduce production costs for an arrangement that supports the drive shaft.

In a preferred embodiment of the present invention, the propulsion device includes a jet pump to generate a thrust by sucking and jetting water with a driving force of the engine, and the vessel is a jet propulsion watercraft.

According to the above structural arrangement, it is possible to reduce production costs for an arrangement that supports the drive shaft that transmits the driving force of the engine to the propulsion device in the jet propulsion watercraft.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
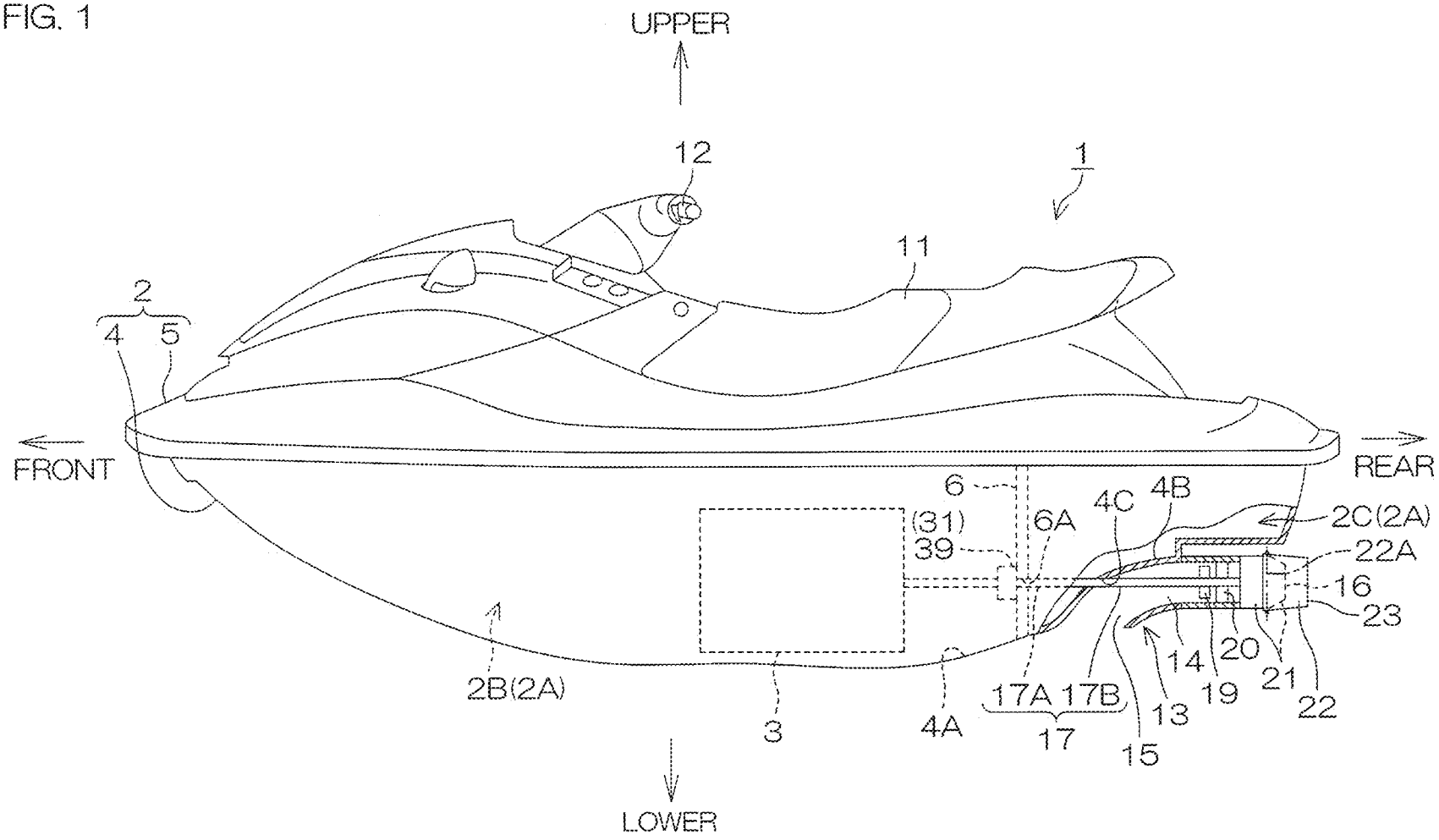
FIG. 1 is a side view of a vessel according to a preferred embodiment of the present invention.

Preferred embodiments of the present invention will be hereinafter described in detail with reference to the accompanying drawings. FIG. 1 is a left side view of a vessel 1 according to a preferred embodiment of the present invention. A left-right direction in FIG. 1 is a front-rear direction of the vessel 1. A left side in FIG. 1 is a front side of the vessel 1. A right side in FIG. 1 is a rear side of the vessel 1. In the following description, the left-right direction of the vessel 1 is defined based on when the vessel 1 is facing forward. In other words, a near side in a direction perpendicular to the plane of paper of FIG. 1 is a left side of the vessel 1, and a far side in the direction perpendicular to the plane of paper of FIG. 1 is a right side of the vessel 1. An example of the vessel 1 is a small vessel that is called a personal watercraft (PWC). The vessel 1 includes a vessel body 2 that is substantially laterally symmetrical and an engine 3 attached to the vessel body 2.

The vessel body 2 includes a hull 4 that defines a vessel bottom and a deck 5 disposed above the hull 4, and extends longitudinally in a front-rear direction. The sectional shape of the hull 4 preferably has a U-shape or a V-shape when the hull 4 is cut by a vertical plane that is perpendicular to the front-rear direction of the vessel 1. Therefore, most of an inner surface 4A of the hull 4 has a U-shape or a V-shape when viewed from the front-rear direction, and the hull 4 includes a concave space defined by the inner surface 4A. An inclined wall 4B that is inclined gradually upwardly as it extends rearwardly is disposed at a rear end portion of the hull 4. The inclined wall 4B includes a through-hole 4C that passes through the inclined wall 4B in the front-rear direction.

The deck 5 closes the concave space of the hull 4 from above. Thus, the vessel body 2 includes an internal space 2A defined between the hull 4 and the deck 5 in an up-down direction. The internal space 2A extends longitudinally in the front-rear direction, and a portions of the internal space 2A is defined by the concave space of the hull 4.

The vessel body 2 additionally includes a partition wall 6. The partition wall 6 is also called a bulkhead. The partition wall 6 includes a vertical plate that extends rightwardly and leftwardly, and is located, for example, at a position closer to the rear in the internal space 2A. The partition wall 6 is disposed at a more forward position than the inclined wall 4B of the hull 4. A lower edge of the partition wall 6 preferably has a U-shape or a V-shape that matches the inner surface 4A of the hull 4 when viewed from the front-rear direction. The internal space 2A is partitioned by the partition wall 6 into a front region 2B located at a more forward position than the partition wall 6 and a rear region 2C located at a more rearward position than the partition wall 6. The partition wall 6 functions not only to partition the internal space 2A but also to reinforce the vessel body 2. The partition wall 6 includes a through-hole 6A that passes through the partition wall 6 in the front-rear direction.

The engine 3 is disposed in the front region 2B of the internal space 2A. The engine 3 is, for example, an internal combustion engine that includes a crankshaft (not shown) that rotates around a crankshaft axis (not shown) extending in the front-rear direction.

The vessel 1 additionally includes a seat 11 on which a crew member or a plurality of crew members sit, a steering handle 12 that is operated by a crew member sitting on the seat 11, and a propulsion device 13 attached to a rear portion of the vessel body 2. The seat 11 and the steering handle 12 are disposed side by side in the front-rear direction in an upper portion of the vessel body 2. More specifically, the seat 11 is disposed at a central portion of the deck 5, and the steering handle 12 is disposed at a position that is able to be reached by the hands of a crew member sitting on the seat 11 when the crew member forwardly extends his/her arms.

A throttle lever (not shown) is attached to a left end portion or a right end portion of the steering handle 12, and the driving force of the engine 3 is adjusted by the operation of the throttle lever by the crew member.

The propulsion device 13 is disposed at a more rearward position than the engine 3. The vessel 1 in the present preferred embodiment is a jet propulsion watercraft, and the propulsion device 13 in this case includes a jet pump that sucks water by the driving force of the engine 3 from the vessel bottom and jets the water outwardly from the vessel body 2. The propulsion device 13 jets water in this way to generate a thrust to propel the vessel 1.

More specifically, the propulsion device 13 includes a cylindrical flow passage 14 that extends rearwardly from the inclined wall 4B of the hull 4, a water intake port 15 that is downwardly opened in a front end portion of the flow passage 14 and through which water existing around the vessel body 2 is sucked in, and a water outlet port 16 that is rearwardly opened in a rear end portion of the flow passage 14. The inside of the flow passage 14 is a space that is different from the internal space 2A of the vessel body 2. The through-hole 4C in the inclined wall 4B faces the inside of the flow passage 14 from the front. The flow passage 14 guides water sucked into the water intake port 15 to the water outlet port 16.

The vessel 1 additionally includes a drive shaft 17 to transmit the driving force of the engine 3 to the propulsion device 13. The drive shaft 17 may be regarded as an element of the propulsion device 13. The drive shaft 17 extends in the front-rear direction. A front portion 17A of the drive shaft 17 passes through the through-hole 4C of the hull 4, and is disposed in the rear region 2C of the internal space 2A of the vessel body 2, and is inserted into an insertion hole 6A of the partition wall 6, and is connected to the crankshaft (not shown) of the engine 3 through a joint 18 (see FIG. 2 described below, for example). A rear portion 17B of the drive shaft 17 is disposed in the flow passage 14. The drive shaft 17 receives the driving force of the engine 3, and thus rotates around a central axis C (see FIG. 3 described below) of the drive shaft 17.

The propulsion device 13 additionally includes an impeller 19 and a stationary blade 20 both of which are disposed in the flow passage 14, a cylindrical nozzle 21 including the water outlet port 16 that defines and functions as the rear end portion of the flow passage 14, and a deflector 22 that rightwardly and leftwardly deflects a water jet direction that extends rearwardly from the water outlet port 16. The impeller 19 is connected to the rear portion 17B of the drive shaft 17, and is rotatable around the central axis of the drive shaft 17. The stationary blade 20 is disposed behind the impeller 19, and is fixed to the flow passage 14. The nozzle 21 is disposed behind the stationary blade 20.

The impeller 19 is rotationally driven by the engine 3 around the central axis of the drive shaft 17 together with the drive shaft 17. When the impeller 19 is rotationally driven, water existing around the vessel body 2 is sucked from the water intake port 15 into the flow passage 14, and is sent from the impeller 19 to the stationary blade 20. The water sent by the impeller 19 passes through the stationary blade 20, and, as a result, the torsion of a water flow caused by the rotation of the impeller 19 is reduced, and the water flow is straightened. Therefore, the straightened water flow is sent from the stationary blade 20 to the nozzle 21. The water outlet port 16 is located in a rear end of the nozzle 21. The water sent to the nozzle 21 is jetted rearwardly from the water outlet port 16.

The deflector 22 is cylindrical, and extends rearwardly from the nozzle 21. The deflector 22 is connected to the nozzle 21 so as to be rightwardly and leftwardly rotatable around a deflector axis 22A that extends upwardly and downwardly. The water outlet port 16 of the nozzle 21 is disposed in the deflector 22. The deflector 22 includes a jet opening 23 that opens rearwardly. The jet opening 23 is disposed behind the water outlet port 16. Water jetted rearwardly from the water outlet port 16 passes through the inside of the deflector 22, and is jetted rearwardly from the jet opening 23. Thus, a jet propulsion force in a forward direction is generated. The deflector 22 rightwardly and leftwardly turns around the deflector axis 22A in accordance with the operation of the steering handle 12. Thus, the direction of water jetted from the propulsion device 13, i.e., the direction of a thrust is rightwardly and leftwardly changed by the operation of the steering handle 12, and therefore the vessel 1 is steered.

The vessel 1 additionally includes a housing bearing 31 that supports the front portion 17A of the drive shaft 17 in the partition wall 6. The partition wall 6 may be regarded as an element of the housing bearing 31. For example, first and second preferred embodiments of the vessel 1 with respect to the housing bearing 31 will be hereinafter described in this order.

First Preferred Embodiment

Figure 2:
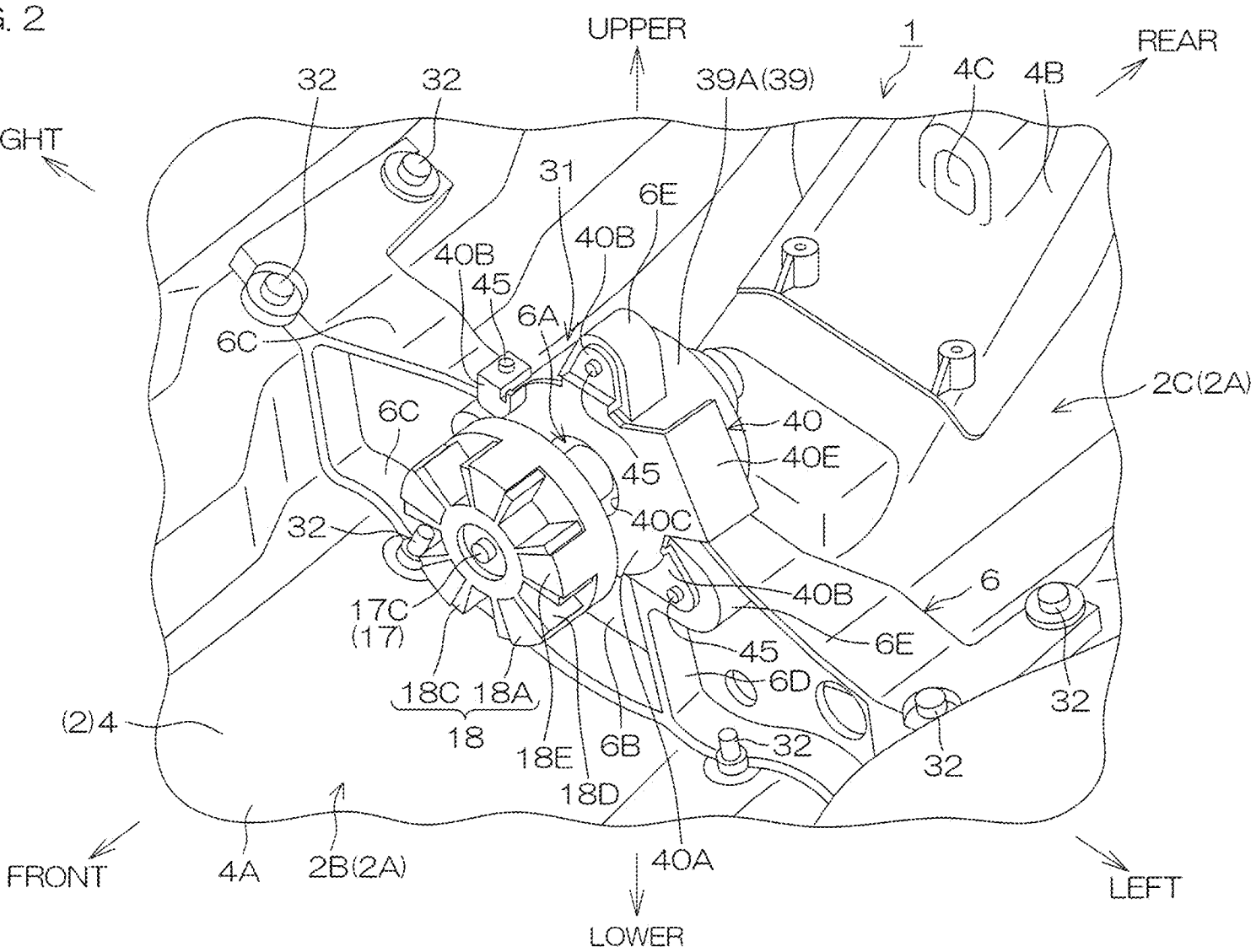
FIG. 2 is a perspective view of an internal structure of a vessel according to a first preferred embodiment of the present invention.

FIG. 2 is a perspective view of an internal structure of a vessel 1 according to a first preferred embodiment of the present invention. The partition wall 6 integrally includes a vertical plate 6B in which the insertion hole 6A is provided and that extends upwardly, downwardly, rightwardly, and leftwardly, a flange 6C that projects in the front-rear direction and surrounds the whole area of the outline of the vertical plate 6B, and a rib 6D that protrudes forwardly or rearwardly from the vertical plate 6B and that is connected to the flange 6C. A left end portion, a right end portion, etc., of the flange 6C are fixed to the inner surface 4A of the hull 4 by a fastening member 32, such as a bolt, and thus the partition wall 6 is fixed to the hull 4.

Figure 3:
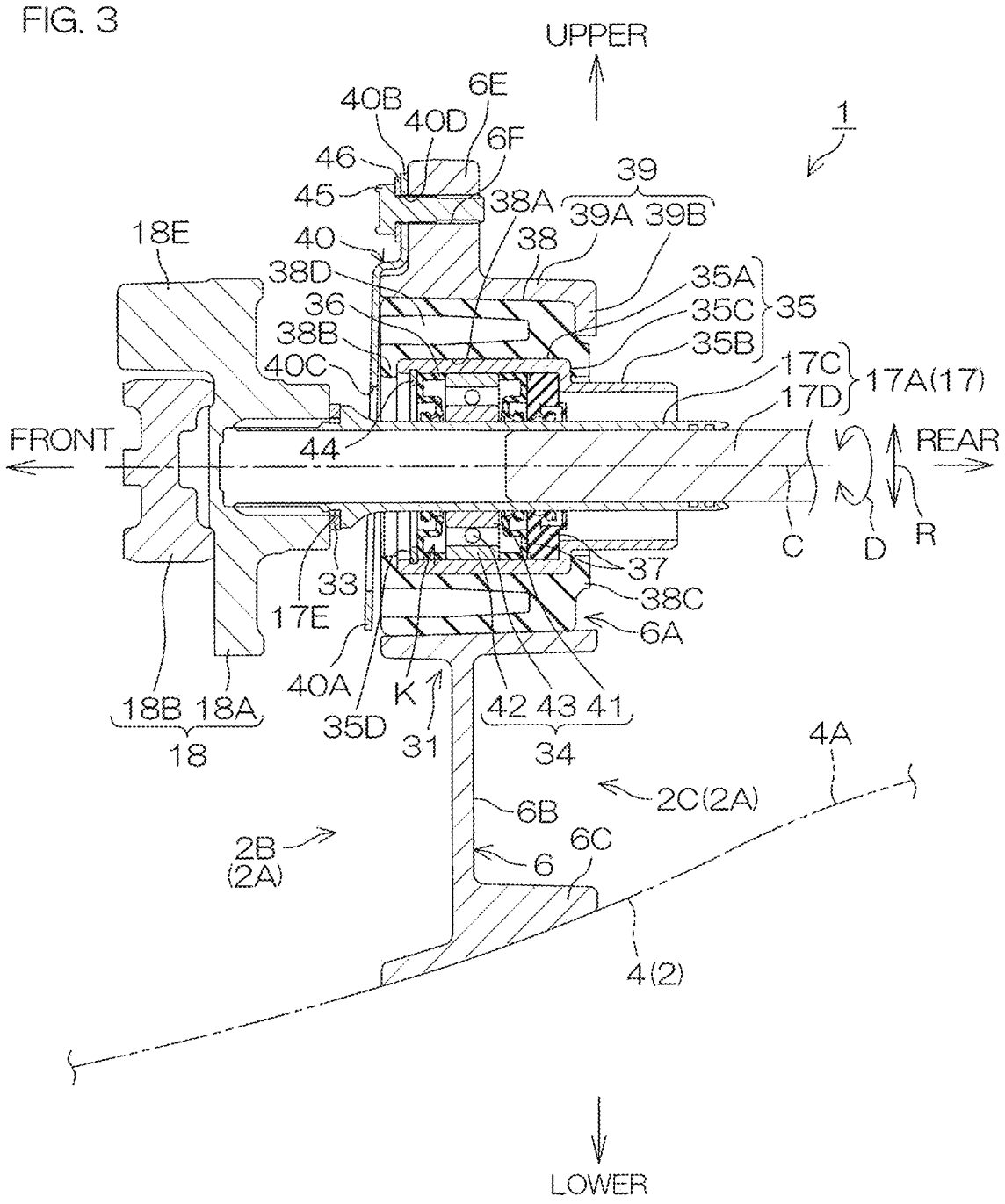
FIG. 3 is a longitudinal sectional view of the internal structure of the vessel according to the first preferred embodiment of the present invention.

FIG. 3 is a longitudinal sectional view of the internal structure of the vessel 1 according to the first preferred embodiment. The front portion 17A of the drive shaft 17 includes a first shaft 17C and a second shaft 17D. The first shaft 17C has a circular tubular shape that extends in the front-rear direction. The second shaft 17D has a solid cylindrical shape that extends in the front-rear direction, and is inserted into a hollow portion of the first shaft 17C from behind. The first shaft 17C and the second shaft 17D are spline-connected to each other, and are rotatable together.

The joint 18 includes a first joint 18A fixed to a front end portion of the first shaft 17C, a second joint 18B fixed to, for example, a rear end portion of the crankshaft (not shown) of the engine 3, and a damper 18C disposed between the first joint 18A and the second joint 18B (see FIG. 2). The first joint 18A and the second joint 18B each have a gear shape so as to engage with each other. The damper 18C has a gear shape and is made of an elastic material such as rubber. In the damper 18C, a plurality of convex portions 18D (see FIG. 2) defining the gear shape are disposed one by one between teeth 18E of the first joint 18A and teeth (not shown) of the second joint 18B, respectively. A shock caused when power is transmitted between the first joint 18A and the second joint 18B is absorbed by the elastic deformation of the convex portion 18D. A central portion of the first joint 18A is tightly screwed into the front end portion of the first shaft 17C. A groove 17E is provided at a front end portion of an outer peripheral surface of the first shaft 17C. An annular washer 33 is fitted to the groove 17E. The first joint 18A is positioned in the front-rear direction due to the washer 33 coming into contact with the first joint 18A from behind. In the outer peripheral surface of the first shaft 17C, the outer diameter of the portion that is contiguous to the groove 17E from behind gradually becomes larger as it extends toward the groove 17E.

The housing bearing 31 includes a bearing 34 that rotatably supports the drive shaft 17, an inner housing 35 that houses the bearing 34, and a first seal 36 and a second seal 37 both of which are disposed in the inner housing 35. The housing bearing 31 additionally includes an elastic member 38 that supports the bearing 34, an outer housing 39 that supports the elastic member 38 and that is fixed to the partition wall 6, and a positioning member 40 that positions the elastic member 38 with respect to the bearing 34 and the outer housing 39.

The bearing 34 is, for example, a ball bearing, and includes an inner ring 41 that is fitted to a portion of the outer peripheral surface of the first shaft 17C that is located at a more rearward position than the groove 17E, an outer ring 42 that surrounds the inner ring 41, and a plurality of rolling elements 43 disposed between the inner ring 41 and the outer ring 42.

The inner housing 35 includes a cylindrical body, and is disposed coaxially with the central axis C of the drive shaft 17, and surrounds a portion of the first shaft 17C of the drive shaft 17 that is located at a more rearward position than the groove 17E. The inner housing 35 is made of metal, for example, such as aluminum. The inner housing 35 integrally includes a first portion 35A that defines and functions as a front portion of the inner housing 35, a second portion 35B that defines and functions as a rear portion of the inner housing 35, and a third portion 35C by which the first portion 35A and the second portion 35B are connected together. The first portion 35A surrounds not only the first shaft 17C but also the bearing 34, the first seal 36, and the second seal 37. The second portion 35B is smaller in diameter than the first portion 35A. A rear end of the first portion 35A and a front end of the second portion 35B are located at the same position in the front-rear direction. The third portion 35C is preferably annular, and connects the rear end of the first portion 35A and the front end of the second portion 35B together.

Each of the first and second seals 36 and 37 includes an annular element, such as a known oil seal or O-ring. The number of the first seals 36 and the number of the second seals 37 can be arbitrarily set. As an example, a single first seal 36 may be disposed side by side with the bearing 34 from the front, and two second seals 37 may be disposed side by side with the bearing 34 from the rear so that the bearing 34 is sandwiched between the first seal 36 and the second seals 37. Likewise, the shape of each of the first and second seals 36 and 37 can be arbitrarily set. As an example, the two second seals 37 may differ in shape from each other. Additionally, the shape of the first seal 36 and the shape of the forward one of the two second seals 37 may be symmetrical in the front-rear direction with respect to the bearing 34 located between the first seal 36 and the second seal 37.

Each of the first and second seals 36 and 37 is in contact with the outer peripheral surface of the first shaft 17C of the drive shaft 17 and with an inner peripheral surface of the first portion 35A of the inner housing 35. Thus, a gap K between the drive shaft 17 and the inner housing 35 is closed.

A groove 35D is provided at a front end portion of the inner peripheral surface of the first portion 35A, and an annular washer 44 is fitted to the groove 35D. An inner peripheral portion of the washer 44 comes into contact with the first seal 36 from the front. Additionally, the third portion 35C of the inner housing 35 comes into contact with the rearward one of the two second seals 37 from the rear. These two second seals 37 are in contact with each other. Additionally, the outer peripheral portion of the first seal 36 comes into contact with the outer ring 42 of the bearing 34 from the front, and the outer peripheral portion of the forward one of the two second seals 37 comes into contact with the outer ring 42 of the bearing 34 from the rear. Therefore, the bearing 34, the first seal 36, and the second seal 37 are positioned in the front-rear direction.

The elastic member 38 has a cylindrical body, and is disposed coaxially with the central axis C of the drive shaft 17, and is made of an elastic material, such as rubber. The elastic member 38 surrounds the first portion 35A of the inner housing 35, and thus surrounds the bearing 34, the first seal 36, the second seal 37, and the first shaft 17C of the drive shaft 17 as well, in the first portion 35A. An inner peripheral portion of the elastic member 38 includes an annular inner peripheral surface 38A that is flat in the front-rear direction along the central axis C, a first engagement portion 38B that projects from a front end of the inner peripheral surface 38A toward the central axis C, and a second engagement portion 38C that projects from a rear end of the inner peripheral surface 38A toward the central axis C. The second engagement portion 38C protrudes rearwardly by one step in a rear end surface of the elastic member 38. The inner peripheral surface 38A comes into contact with an outer peripheral surface of the first portion 35A, and the first engagement portion 38B comes into contact with a front end surface of the first portion 35A from the front, and the second engagement portion 38C comes into contact with a rear end surface of the first portion 35A from the rear. Thus, the elastic member 38 is attached to the first portion 35A so as not to come off the first portion 35A. The elastic member 38 in this state supports the bearing 34 disposed in the first portion 35A through the first portion 35A.

The elastic member 38 includes a single or a plurality of holes 38D that extend rearwardly from a front end surface of the elastic member 38 to lighten the weight of the elastic member 38. The hole 38D may or may not pass through the elastic member 38 in the front-rear direction. In the present preferred embodiment, a plurality of holes 38D that do not pass through the elastic member 38 are disposed side by side in a circumferential direction of the elastic member 38. The circumferential direction of the elastic member 38 is the same as a circumferential direction D around the central axis C of the drive shaft 17.

The outer housing 39 includes a cylindrical body, and is disposed coaxially with the central axis C of the drive shaft 17. The outer housing 39 is made of metal, for example, such as aluminum. The outer housing 39 surrounds the elastic member 38, and thus surrounds the inner housing 35 disposed in the elastic member 38 as well. Therefore, the outer housing 39 also surrounds the bearing 34, the first seal 36, the second seal 37, and the first shaft 17C of the drive shaft 17 in the first portion 35A of the inner housing 35.

The outer housing 39 includes, at least, a peripheral wall 39A that extends in the circumferential direction D of the drive shaft 17. As an arrangement specific to the first preferred embodiment, the outer housing 39 is integral and unitary with the partition wall 6, and the outer housing 39 additionally includes a rear engagement portion 39B that projects from a rear end portion of the peripheral wall 39A toward the central axis C of the drive shaft 17. A halfway portion of the peripheral wall 39A in the front-rear direction, i.e., more specifically, a closer-to-the-front portion of the peripheral wall 39A is connected to the vertical plate 6B of the partition wall 6. Therefore, the peripheral wall 39A protrudes forwardly or rearwardly from the vertical plate 6B.

A space surrounded by the outer housing 39, i.e., an internal space of the outer housing 39 defines the insertion hole 6A of the partition wall 6. Therefore, the elastic member 38, the first portion 35A of the inner housing 35, the bearing 34, the first seal 36, the second seal 37, and a portion of the first shaft 17C of the drive shaft 17 are disposed at the insertion hole 6A. A rear portion of the second portion 35B protrudes rearwardly from the insertion hole 6A although a front end portion of the second portion 35B of the inner housing 35 is disposed at the insertion hole 6A.

An inner peripheral surface of the peripheral wall 39A is in contact with an outer peripheral surface of the elastic member 38. The rear engagement portion 39B comes into contact with an outer peripheral portion of a rear end surface of the elastic member 38 from the rear, and surrounds the second engagement portion 38C of the elastic member 38. A front end surface of the peripheral wall 39A is located at substantially the same position in the front-rear direction as the front end surface of the elastic member 38, and these front end surfaces are substantially flush with each other along a radial direction R with respect to the central axis C of the drive shaft 17. The elastic member 38 is disposed between the first portion 35A of the inner housing 35 and the peripheral wall 39A of the outer housing 39, and is in contact with the first portion 35A and with the peripheral wall 39A, and yet is not bonded to the inner housing 35 and is not bonded to the outer housing 39.

The positioning member 40 according to the first preferred embodiment preferably has the shape of a thin plate, for example, and integrally includes a vertical plate portion 40A and a single or a plurality of fixed portions 40B (in the present preferred embodiment, a plurality of fixed portions 40B). The vertical plate portion 40A preferably has a disk shape that is equal or substantially equal in diameter to the outer housing 39, and includes a through-hole 40C that passes through the vertical plate portion 40A in the front-rear direction at the center of the vertical plate portion 40A. Each of the fixed portions 40B is disposed at an outer peripheral portion of the vertical plate portion 40A, and is bent rearwardly, and then is further bent outwardly in the radial direction R. A through-hole 40D is provided in each of the fixed portions 40B.

The positioning member 40 is disposed so that the vertical plate portion 40A faces the elastic member 38 and the outer housing 39 from the front. Each of the fixed portions 40B of the positioning member 40 faces any portion of the partition wall 6. A projection portion 6E that projects from the flange 6C, the rib 6D, etc., and that faces the fixed portion 40B may be disposed at the partition wall 6 (see FIG. 2). A threaded hole 6F is provided in a portion of the partition wall 6 that faces the through-hole 40D of each of the fixed portions 40B. In the present preferred embodiment, a fastening member 45 including a bolt, for example, is inserted into each of the through-holes 40D, and is tightened into the threaded hole 6F. Thus, the positioning member 40 is fixed to the partition wall 6. A washer 46 may be disposed between a head portion of the bolt of the fastening member 45 and the partition wall 6. The positioning member 40 may include a bent portion 40E that is disposed at the outer peripheral portion of the vertical plate portion 40A separately from the fixed portion 40B and that is bent rearwardly (see FIG. 2). The bent portion 40E is disposed along an outer peripheral surface of the peripheral wall 39A of the outer housing 39.

In the positioning member 40 fixed to the partition wall 6 in this way, the vertical plate portion 40A rearwardly presses at least one portion (in FIG. 3, an upper region) of the front end surface of the elastic member 38. Thus, the first engagement portion 38B of the elastic member 38 is pressed against a front end surface of the inner housing 35. Additionally, an outer peripheral portion of the rear end surface of the elastic member 38 is pressed against the rear engagement portion 39B of the outer housing 39 that defines a portion of the partition wall 6 in the first preferred embodiment. In other words, the vertical plate portion 40A presses the elastic member 38 toward the partition wall 6. Thus, the elastic member 38 is compressed in the front-rear direction between the vertical plate portion 40A and the rear engagement portion 39B, and, in accordance with this compression, spreads inwardly and outwardly in the radial direction R. Therefore, the elastic member 38 is tightly pressed into contact with the outer peripheral surface of the first portion 35A of the inner housing 35, and is tightly pressed into contact with the inner peripheral surface of the peripheral wall 39A of the outer housing 39. The elastic member 38 in this state is positioned in the front-rear direction and in the radial direction R with respect to the inner housing 35, with respect to the outer housing 39, and with respect to the bearing 34 disposed in the inner housing 35. The front end portion including the groove 17E in the first shaft 17C of the drive shaft 17 passes through the through-hole 40C of the vertical plate portion 40A, and is disposed at a more forward position (a side of the engine 3) than the through-hole 40C.

Second Preferred Embodiment

Figure 4:
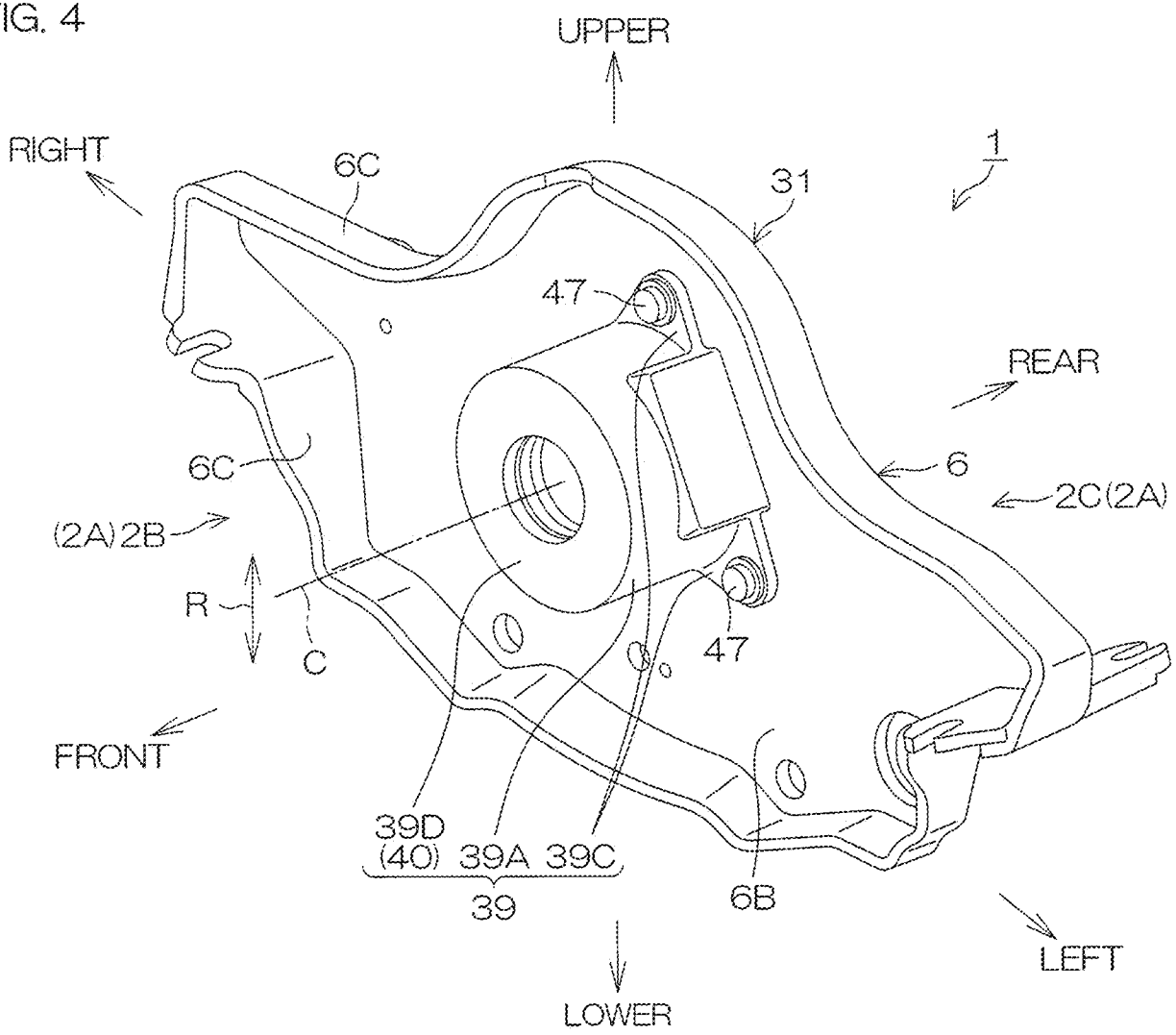
FIG. 4 is a perspective view of an internal structure of a vessel according to a second preferred embodiment of the present invention.

In the following description, the same reference numerals are given to functionally-identical components with already-described components of the first preferred embodiment, and a description of the functionally-identical components is omitted. FIG. 4 is a perspective view of an internal structure of a vessel 1 according to a second preferred embodiment of the present invention.

A vessel 1, such as a sports boat larger in size than a personal watercraft, according to the second preferred embodiment includes a partition wall 6 that is larger at least laterally than the partition wall 6 according to the first preferred embodiment. Therefore, it is difficult to design the partition wall 6 according to the second preferred embodiment so as to have a complicated shape, and therefore the partition wall 6 according to the second preferred embodiment has a comparatively simple shape in which the rib 6D and the projection portion 6E are omitted although it does include the vertical plate 6B and the flange 6C.

In the second preferred embodiment, the outer housing 39 is a component different from the partition wall 6. The outer housing 39 integrally includes, in addition to the peripheral wall 39A, a single or a plurality of fixed portions 39C (in the present preferred embodiment, a plurality of fixed portions 39C) that protrude outwardly in the radial direction R from the rear end portion of the peripheral wall 39A and an annular end wall 39D that is connected to the front end portion of the peripheral wall 39A and that projects inwardly in the radial direction R. In the second preferred embodiment, the end wall 39D defines and functions as the positioning member 40 described above. In other words, the positioning member 40 includes the end wall 39D.

Figure 5:
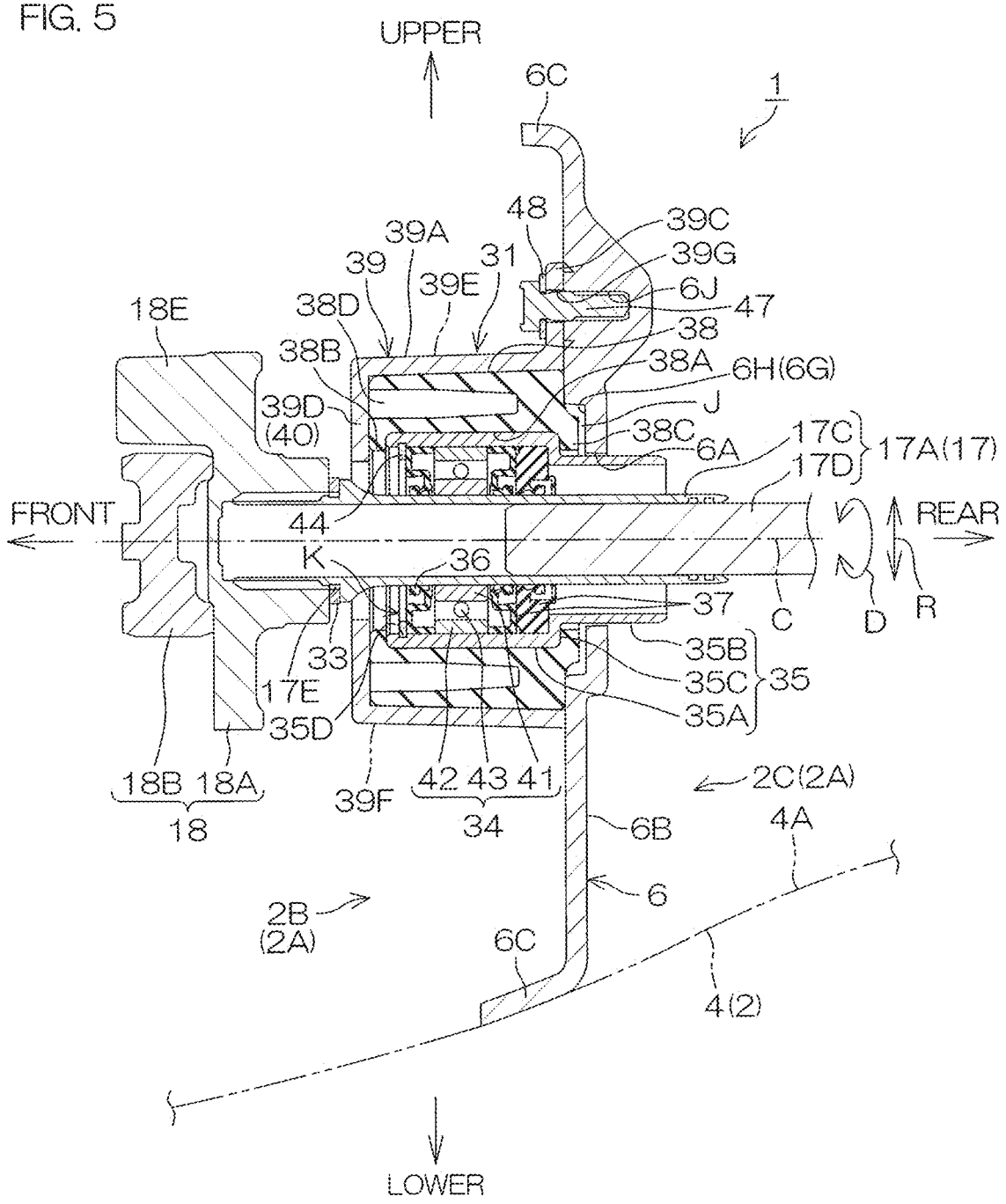
FIG. 5 is a longitudinal sectional view of the internal structure of the vessel according to the second preferred embodiment of the present invention.

FIG. 5 is a longitudinal sectional view of the internal structure of the vessel 1 according to the second preferred embodiment. The outer housing 39 may be an integral and unitary structure, or may include a plurality of elements, i.e., may include, for example, a closer-to-the-upper first element 39E and a closer-to-the-lower second element 39F so that the outer housing 39 is able to be separated into these elements.

In the housing bearing 31, components that are different from the partition wall 6, the outer housing 39, and the positioning member 40 are arranged in substantially the same way in the first preferred embodiment and the second preferred embodiment, i.e., the bearing 34, the inner housing 35, the first seal 36, the second seal 37, and the elastic member 38 are arranged in substantially the same way in the first preferred embodiment and the second preferred embodiment. However, the bearing 34, the first seal 36, the second seal 37, the elastic member 38, and the first portion 35A of the inner housing 35 are disposed at more forward positions than the insertion hole 6A of the vertical plate 6B of the partition wall 6, respectively. The second portion 35B of the inner housing 35 extends to the vertical plate 6B rearward from the first portion 35A in a state of surrounding the first shaft 17C of the drive shaft 17, and is inserted into the insertion hole 6A. A rear end portion of the second portion 35B protrudes rearwardly from the insertion hole 6A.

In the second preferred embodiment, an annular concave portion 6G that is rearwardly hollowed while surrounding the insertion hole 6A is provided at a front surface of the vertical plate 6B. The bottom of the concave portion 6G defines a peripheral edge portion 6H of the insertion hole 6A in the vertical plate 6B. In the elastic member 38 surrounding the first portion 35A of the inner housing 35, the closer-to-the-rear second engagement portion 38C is fitted to the concave portion 6G, and is sandwiched between the rear end of the first portion 35A and the peripheral edge portion 6H of the insertion hole 6A.

The outer housing 39 faces the vertical plate 6B of the partition wall 6 from the front. Each of the fixed portions 39C of the outer housing 39 comes into contact with any portion of the vertical plate 6B from the front. Each of the fixed portions 39C includes a through-hole 39G that passes through the fixed portion 39C in the front-rear direction. A threaded hole 6J is provided in a portion of the vertical plate 6B that faces the through-hole 39G of each of the fixed portions 39C. In the present preferred embodiment, a connection member 47 including a bolt is inserted into each of the through-holes 39G from the front, and is tightened into the threaded hole 6J, as an element of the housing bearing 31. Thus, the entirety of the outer housing 39 is connected to the partition wall 6. A washer 48 may be disposed between a head portion of the bolt in the connection member 47 and the partition wall 6. The end wall 39D of the outer housing 39 surrounds the first shaft 17C of the drive shaft 17 in a non-contact manner. The end wall 39D extends in the radial direction R that intersects with the drive shaft 17 (in the present preferred embodiment, perpendicular or substantially perpendicular to the drive shaft 17). The front end portion of the first shaft 17C at which the groove 17E is provided is disposed at a more forward position than the end wall 39D.

In the outer housing 39 connected to the partition wall 6 as described above, the inner peripheral surface of the peripheral wall 39A is in contact with the outer peripheral surface of the elastic member 38, and the end wall 39D rearwardly presses at least one portion (in FIG. 5, the whole area) of the front end surface of the elastic member 38 in the same way as the positioning member 40. Thus, the first engagement portion 38B of the elastic member 38 is pressed against the front end surface of the inner housing 35. Additionally, the outer peripheral portion of the rear end surface of the elastic member 38 is pressed against the vertical plate 6B of the partition wall 6. In other words, the end wall 39D presses the elastic member 38 toward the vertical plate 6B. Thus, the elastic member 38 is compressed in the front-rear direction between the end wall 39D and the vertical plate 6B, and, in accordance with this compression, spreads inwardly and outwardly in the radial direction R. Therefore, the elastic member 38 is tightly pressed into contact with the outer peripheral surface of the first portion 35A of the inner housing 35, and is tightly pressed into contact with the inner peripheral surface of the peripheral wall 39A of the outer housing 39. The elastic member 38 in this state is positioned in the front-rear direction and in the radial direction R with respect to the inner housing 35, with respect to the outer housing 39, and with respect to the bearing 34 disposed in the inner housing 35. It should be noted that the second engagement portion 38C fitted to the concave portion 6G of the partition wall 6 in the elastic member 38 may be slightly spaced forwardly from the bottom (peripheral edge portion 6H) of the concave portion 6G.

As described above, according to the first and second preferred embodiments, the drive shaft 17 is rotated by the driving force of the engine 3, and the driving force of the engine 3 is transmitted to the propulsion device 13 due to the rotation of the drive shaft 17. The propulsion device 13 generates a thrust by the transmission of the driving force of the engine 3. The drive shaft 17 is rotatably supported by the bearing 34 in a state in which the drive shaft 17 is inserted in the insertion hole 6A in the partition wall 6. The bearing 34 is elastically supported by the elastic member 38, and therefore vibrations of the drive shaft 17 and of the bearing 34, which result from the rotation of the drive shaft 17 and the like, are absorbed by the elastic deformation of the elastic member 38. Therefore, it is possible to significantly reduce or prevent vibrations of the drive shaft 17 and of the bearing 34 from being transmitted to the vessel body 2. Additionally, the displacement of the drive shaft 17 and the displacement of the bearing 34 are permitted when vibrations occur, and, as a result, fatigue caused by vibrations is not easily accumulated on these components, and therefore it is possible to significantly reduce or prevent these components from being broken.

The elastic member 38 is supported by the outer housing 39 fixed to the partition wall 6. Additionally, the elastic member 38 is pressed by the positioning member 40, and thus is positioned with respect to the bearing 34 and the outer housing 39. Therefore, the elastic member 38 is not required to be bonded to the bearing 34 and to the outer housing 39 in order to position the elastic member 38. Therefore, it is possible to reduce production costs for an arrangement that supports the drive shaft 17.

Additionally, in the first and second preferred embodiments, the housing bearing 31, which is an element that supports the drive shaft 17, is fixed to the partition wall 6 by the outer housing 39. Therefore, even in various kinds of vessels 1 that differ from each other in the peripheral structure of the drive shaft 17 or in the size, etc., of the vessel body 2, it is possible to attach the housing bearing 31 to the vessel body 2 by using the partition wall 6 and the outer housing 39. For example, if a plurality of partition walls 6 are provided, it is possible to optimize the position of the housing bearing 31 by disposing the housing bearing 31 at a partition wall 6 located at an appropriate position. This makes it possible to allow the drive shaft 17 supported by the bearing 34 of the housing bearing 31 to smoothly rotate without a wobble.

In the first and second preferred embodiments, the positioning member 40 presses the elastic member 38 toward the partition wall 6, and, as a result, the elastic member 38 is positioned with respect to the bearing 34 and the outer housing 39. According to the above structural arrangement, the elastic member 38 is pressed toward the partition wall 6 by the positioning member 40, and thus is compressed in a pressing direction (in the present preferred embodiment, in the front-rear direction) by the positioning member 40. Accordingly, the elastic member 38 spreads in a direction (in the present preferred embodiment, in the radial direction R) that intersects the pressing direction. The bearing 34 and the outer housing 39 extend in the direction in which the elastic member 38 spreads, and therefore the spreading elastic member 38 is positioned with respect to the bearing 34 and the outer housing 39 by being tightly pressed into contact with the bearing 34 and the outer housing 39. Thus, the elastic member 38 is not required to be bonded to the bearing 34 and to the outer housing 39 in order to position the elastic member 38. Therefore, it is possible to reduce production costs for an arrangement that supports the drive shaft 17. Preferably, a certain degree of fastening allowance is reserved for the elastic member 38 during an assembly process in which it has not yet been pressed by the positioning member 40 so that the elastic member 38 is able to be deformed as above.

In the first and second preferred embodiments, the partition wall 6 is fixed to the vessel body 2, and the outer housing 39 supports the elastic member 38 in a state in which the outer housing 39 is fixed to the partition wall 6. Thus, the elastic member 38 is fixed to the vessel body 2 through the outer housing 39 and the partition wall 6, thus making it possible to support the bearing 34 in a state in which positional stability is maintained. This enables the bearing 34 to support the drive shaft 17 in a state in which positional stability is maintained.

In the first and second preferred embodiments, the elastic member 38 supports the bearing 34 through the inner housing 35 that houses the bearing 34. In this case, when the positioning member 40 positions the elastic member 38 with respect to the inner housing 35 by pressing the elastic member 38, the elastic member 38 is also positioned with respect to the bearing 34 disposed in the inner housing 35. Thus, the elastic member 38 is not required to be bonded to the inner housing 35 and to the outer housing 39 in order to position the elastic member 38. Therefore, it is possible to reduce production costs for an arrangement that supports the drive shaft 17.

In the first and second preferred embodiments, even if the elastic member 38 is not bonded to the inner housing 35 and is not bonded to the outer housing 39, the elastic member 38 is positioned with respect to the inner housing 35 and the outer housing 39 by being pressed by the positioning member 40. Thus, the elastic member 38 is not required to be bonded to the inner housing 35, to the bearing 34 disposed in the inner housing 35, and to the outer housing 39. Therefore, it is possible to reduce production costs for an arrangement that supports the drive shaft 17.

In the first preferred embodiment, the outer housing 39 that supports the bearing 34 through the elastic member 38 is integral and unitary with the partition wall 6, and therefore it is possible to reduce the number of components. Therefore, it is possible to reduce production costs for an arrangement that supports the drive shaft 17. Additionally, it is possible to achieve a weight reduction by an integrated structure of the partition wall 6 and the outer housing 39.

In the first preferred embodiment, the outer housing 39 that supports the bearing 34 through the elastic member 38 includes a cylindrical body that is simple in shape, and therefore it is possible to easily produce the outer housing 39. Therefore, it is possible to reduce production costs for an arrangement that supports the drive shaft 17.

In the second preferred embodiment, although the outer housing 39 that supports the bearing 34 through the elastic member 38 is a component different from the partition wall 6, the outer housing 39 includes a cylindrical body that is simple in shape, and therefore it is possible to easily produce the outer housing 39. Therefore, it is possible to reduce production costs for an arrangement that supports the drive shaft 17.

In the second preferred embodiment, the end wall 39D of the outer housing 39 that supports the bearing 34 through the elastic member 38 also defines and functions as a positioning member 40 that positions the elastic member 38, and therefore it is possible to reduce the number of components. Therefore, it is possible to reduce production costs for an arrangement that supports the drive shaft 17.

In the first and second preferred embodiments, if it is difficult to produce the outer housing 39 that supports the bearing 34 through the elastic member 38 as an integral structure, it is possible to define the outer housing 39 by using a plurality of components that are separable from each other as described above. An operator is able to complete the outer housing 39 by combining these components together. This makes it possible to provide the outer housing 39 with a desired structure, and makes it possible to reduce production costs for an arrangement that supports the drive shaft 17.

In the first and second preferred embodiments, the inner housing 35 that houses the bearing 34 includes a cylindrical body that is simple in shape, and therefore it is possible to easily produce the inner housing 35. Therefore, it is possible to reduce production costs for an arrangement that supports the drive shaft 17.

In the first and second preferred embodiments, a gap K between the inner housing 35 and the drive shaft 17 supported by the bearing 34 in the inner housing 35 is closed by the first seal 36, and therefore it is possible to significantly reduce or prevent foreign substances, such as water, from entering the gap K.

In the first and second preferred embodiments, the gap K between the inner housing 35 and the drive shaft 17 supported by the bearing 34 in the inner housing 35 is closed not only by the first seal 36 but also by the second seal 37 so that the bearing 34 is sandwiched between the first seals 36 and the second seal 37. This makes it possible to more significantly reduce or prevent foreign substances, such as water, from entering the gap K, and additionally makes it possible to significantly reduce or prevent foreign substances from adhering to the bearing 34.

In the first and second preferred embodiments, a portion of the drive shaft 17 supported by the bearing 34 that is inserted in the insertion hole 6A of the partition wall 6 is surrounded by the second portion 35B of the inner housing 35 that houses the bearing 34, and therefore the portion of the drive shaft 17 is isolated from the peripheral edge portion of the insertion hole 6A of the partition wall 6. Thus, even if the bearing 34 supported by the elastic member 38 is displaced by vibrations or the like, the drive shaft 17 displaced together with the bearing 34 is protected by the second portion 35B so as not to come into contact with the peripheral edge portion of the insertion hole 6A of the partition wall 6. Therefore, it is possible to significantly reduce or prevent the drive shaft 17 from being broken by the contact of the drive shaft 17 with the peripheral edge portion of the insertion hole 6A.

In the first and second preferred embodiments, the elastic member 38 that supports the bearing 34 includes a cylindrical body that is simple in shape, and therefore it is possible to easily produce the elastic member 38. Therefore, it is possible to reduce production costs for an arrangement that supports the drive shaft 17.

In the second preferred embodiment, a gap J (see FIG. 5) between the first portion 35A of the inner housing 35 and the peripheral edge portion of the insertion hole 6A of the partition wall 6 is closed by the second engagement portion 38C of the elastic member 38, and therefore it is possible to significantly reduce or prevent foreign substances, such as water, from entering the gap J.

In the first and second preferred embodiments, the hole 38D is provided in the elastic member 38. According to the above structural arrangement, it is possible to reduce the amount of material of the elastic member 38 that supports the bearing 34, and therefore it is possible to reduce production costs for an arrangement that supports the drive shaft 17. Additionally, it is possible to adjust the spring constant of the elastic member 38 that is deformed by being pressed by the positioning member 40 in accordance with the size or the shape of the hole 38D. Thus, it is possible to adjust the degree of adhesion of the elastic member 38 to the bearing 34 and to the outer housing 39 by adjusting the spring constant of the elastic member 38. Therefore, it is possible to position the elastic member 38 with respect to the bearing 34 and with respect to the outer housing 39 by the necessary strength even if the elastic member 38 is not bonded to the bearing 34 and to the outer housing 39. Therefore, it is possible to reduce production costs for an arrangement that supports the drive shaft 17.

Although preferred embodiments of the present invention have been described above, the present invention is not restricted to the contents of these preferred embodiments and various modifications are possible within the scope of the present invention.

For example, the vessel 1 is a jet propulsion watercraft in which the propulsion device 13 includes a jet pump in the above-described preferred embodiments, and therefore it is possible to reduce production costs in the jet propulsion watercraft as described above. Of course, the propulsion device 13 may be a known propulsion device except a jet pump, and the vessel 1 may be a vessel except a jet propulsion watercraft. A vessel including an inboard/outboard motor or including an inboard motor are examples of vessels except the jet propulsion watercraft. In the inboard/outboard motor, an engine is disposed inside the vessel and in which a drive unit including a thrust generating member and a steering mechanism is disposed outside the vessel. The engine and the drive unit are connected together by a drive shaft. The inboard motor has both an engine and a drive unit built into a vessel body and in which a propeller shaft extends from the drive unit to the outside of the vessel.

Additionally, the inner housing 35 may be omitted, and the elastic member 38 may directly support the bearing 34.

Various features described above may be appropriately combined together.

Also, features of two or more of the various preferred embodiments described above may be combined.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vessel comprising:
a vessel body;
an engine;
a propulsion device to generate a thrust with a driving force of the engine;
a drive shaft to transmit the driving force of the engine to the propulsion device;
a partition wall including an insertion hole into which the drive shaft is inserted;
a bearing that rotatably supports the drive shaft;
an elastic member to support the bearing;
an outer housing that supports the elastic member and is fixed to the partition wall; and
a positioning member that positions the elastic member with respect to the bearing and the outer housing by pressing the elastic member.

2. The vessel according to claim 1, wherein the positioning member positions the elastic member with respect to the bearing and the outer housing by pressing the elastic member toward the partition wall.

3. The vessel according to claim 1, wherein the partition wall is fixed to the vessel body.

4. The vessel according to claim 1, further comprising:
an inner housing that houses the bearing; wherein
the elastic member supports the bearing through the inner housing.

5. The vessel according to claim 4, wherein the elastic member is not bonded to the inner housing or to the outer housing.

6. The vessel according to claim 5, wherein the outer housing is integral and unitary with the partition wall.

7. The vessel according to claim 6, wherein the outer housing includes a cylindrical body that surrounds the drive shaft.

8. The vessel according to claim 5, wherein
the outer housing includes a cylindrical body surrounding the drive shaft;
the cylindrical body includes a peripheral wall that extends in a circumferential direction of the drive shaft, and an end wall that is connected to an end portion of the peripheral wall and intersects the drive shaft;
the outer housing faces the partition wall; and
the vessel further comprises a connector that connects the peripheral wall to the partition wall.

9. The vessel according to claim 8, wherein the positioning member includes the end wall.

10. The vessel according to claim 5, wherein the outer housing includes a plurality of components that are separable from each other.

11. The vessel according to claim 5, wherein the inner housing includes a cylindrical body that surrounds the drive shaft.

12. The vessel according to claim 11, further comprising a first seal disposed side by side with the bearing in the inner housing and that closes a gap between the inner housing and the drive shaft.

13. The vessel according to claim 12, further comprising a second seal disposed so that the bearing is sandwiched between the first seal and the second seal in the inner housing and that closes a gap between the inner housing and the drive shaft.

14. The vessel according to claim 13, wherein the inner housing includes:

a first portion that surrounds the bearing, the first seal, and the second seal; and a second portion that is smaller in diameter than the first portion and that is inserted into the insertion hole and extends from the first portion to the partition wall in a state in which the second portion surrounds the drive shaft.

15. The vessel according to claim 14, wherein the elastic member includes a cylindrical body that surrounds the drive shaft.

16. The vessel according to claim 15, wherein the elastic member includes a portion sandwiched between the first portion and a peripheral edge portion of the insertion hole in the partition wall.

17. The vessel according to claim 15, wherein the elastic member includes a hole.

18. The vessel according to claim 1, wherein the propulsion device includes a jet pump that generates the thrust by sucking and jetting water with the driving force of the engine.

* * * * *